United States Patent [19]

Nelson

[11] 4,012,034

[45] Mar. 15, 1977

[54] MULTIPLE MODULAR SORTER SYSTEM

[75] Inventor: John A. Nelson, Pittsford, N.Y.

[73] Assignee: Xerox Corporation, Stamford, Conn.

[22] Filed: Sept. 25, 1975

[21] Appl. No.: 616,796

[52] U.S. Cl. ..... 271/173

[51] Int. Cl.[2] ..... B65H 29/58

[58] Field of Search ..... 271/173, 64; 270/58

[56] References Cited

UNITED STATES PATENTS

| | | | |
|---|---|---|---|
| 3,467,371 | 9/1969 | Britt et al. | 270/58 |
| 3,618,936 | 11/1971 | Ziehm | 271/173 |
| 3,709,480 | 1/1973 | Schulze | 271/173 |

*Primary Examiner*—Evon C. Blunk
*Assistant Examiner*—Bruce H. Stoner, Jr.

[57] ABSTRACT

An improved sorter control system for controlling modular sorting assemblies which receive copy sheets from a duplicating machine and distribute the sheets into bins to form collated sets of document information being reproduced. The control system uses two states of a cam operated switch in conjunction with two contacts of a relay which changes state as a sheet of paper interrupts a light beam in each of the modular sorter assemblies. In this manner both the lead edge and the trail edge of a copy sheet breaking and clearing, respectively, the light beam upon entering a bin are recognized causing an index mechanism which controls the sequence of opening the gates for each of the bins to advance. The gate last opened directs copy sheets to the next modular sorting assembly to continue the sorting operation.

1 Claim, 6 Drawing Figures

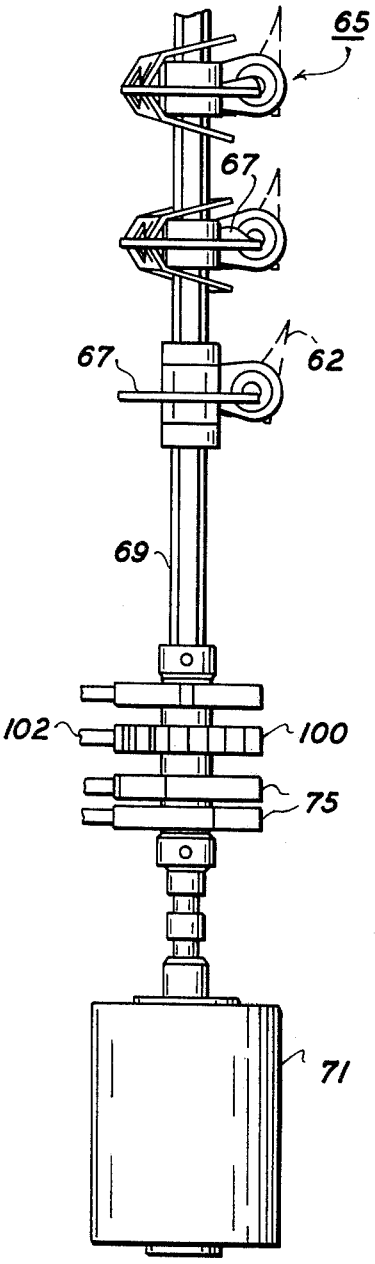
FIG. 2
FIG. 4
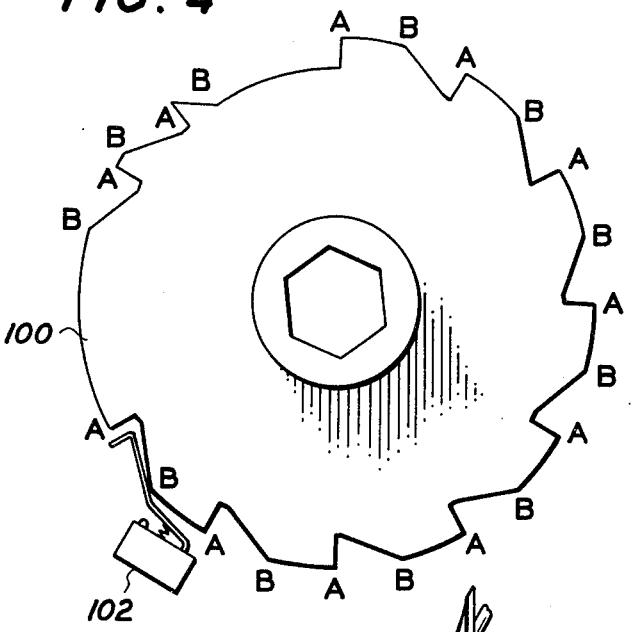
FIG. 3
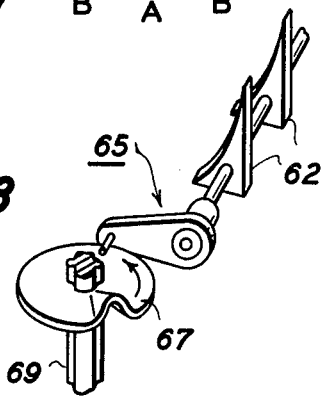
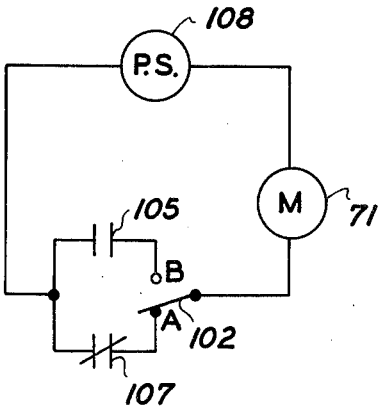
FIG. 5

MULTIPLE MODULAR SORTER SYSTEM

This invention relates in general to copier/duplicator machines and in particular to an improved control system for modular sorting assemblies which distribute copy sheets in collated sets of document information produced on the copier/duplicator machine. The instant application incorporates by reference U.S. Pat. Nos. 3,567,214 issued on Mar. 2, 1971 and 3,467,371 issued on Sept. 16, 1969 describing document feeding and sheet sorting apparatus, respectively, and commonly assigned herewith.

Since the advent of the basic xerographic process as disclosed in U.S. Pat. No. 2,297,691 to Carlson a variety of machines for copying and duplicating have been placed in commercial use. Many of the duplicator machines have modular sorting assemblies for distributing copy sheets into trays or bins in collated sets as described, for example, in the above patent and U.S. Pat. Nos. 3,460,824 and 3,774,906. Usually the entry of the sheets into each of the trays is controlled by a gate mechanism which deflects the sheets into the trays in sequence from a sheet path along a transport.

In the past there has been a problem in the sense that it was necessary to remember whether the lead edge or trail edge of the sheet was blocking the light beam and it was required that there be complete entry of the copy sheet into the tray before the next action could be initiated. As a result the circuitry was complex. Also it was essential that the spacing between sheets be separated by a minimum distance which was equal to the distance between the upper and lower trays of each modular sorting assembly because the last sheet had to clear the light beam before the last gate directing sheets into the next modular sorter assembly could function.

In accordance with the present invention a new and improved indexing mechanism and control system is provided which does not require a memory to determine whether the trail or leading edge of the copy sheet is passing through a light sensing device. Nor does the instant invention require that a minimum spacing between copy sheets be equal to the distance between the upper and lower trays of a modular sorting assembly. As a result, the required speed of the paper movement in a particular modular sorter assembly is considerably reduced with a greater reliability of operation.

It is therefore an object of this invention to improve copier/duplicator systems.

It is a further object of this invention to improve copier/duplicator systems in which document information is produced in collated sets in modular sorter assemblies.

It is another object of this invention to distribute copy sheets in collated fashion to a plurality of modular sorter assemblies with improved control and reliability.

It is a further object of the present invention to improve the handling of copy sheets by a plurality of modular sorter assemblies which are used to distribute copy sheets in collated sets of document information produced by a copier/duplicator machine.

For a better understanding of the invention as well as other objects and further features thereof, reference is had to the following detailed description of the invention which is to be read in conjunction with the accompanying drawings.

FIG. 2 is an enlarged view of the indexing mechanism for activating the diverting gates of a modular sorter assembly;

FIG. 3 is an enlarged perspective view of an actuator for actuating a set of gate members;

FIG. 4 is an enlarged view of the cam of the indexing mechanism;

FIG. 5 is a schematic view of the electrical circuit of the control system according to the present invention.

Figure 1:
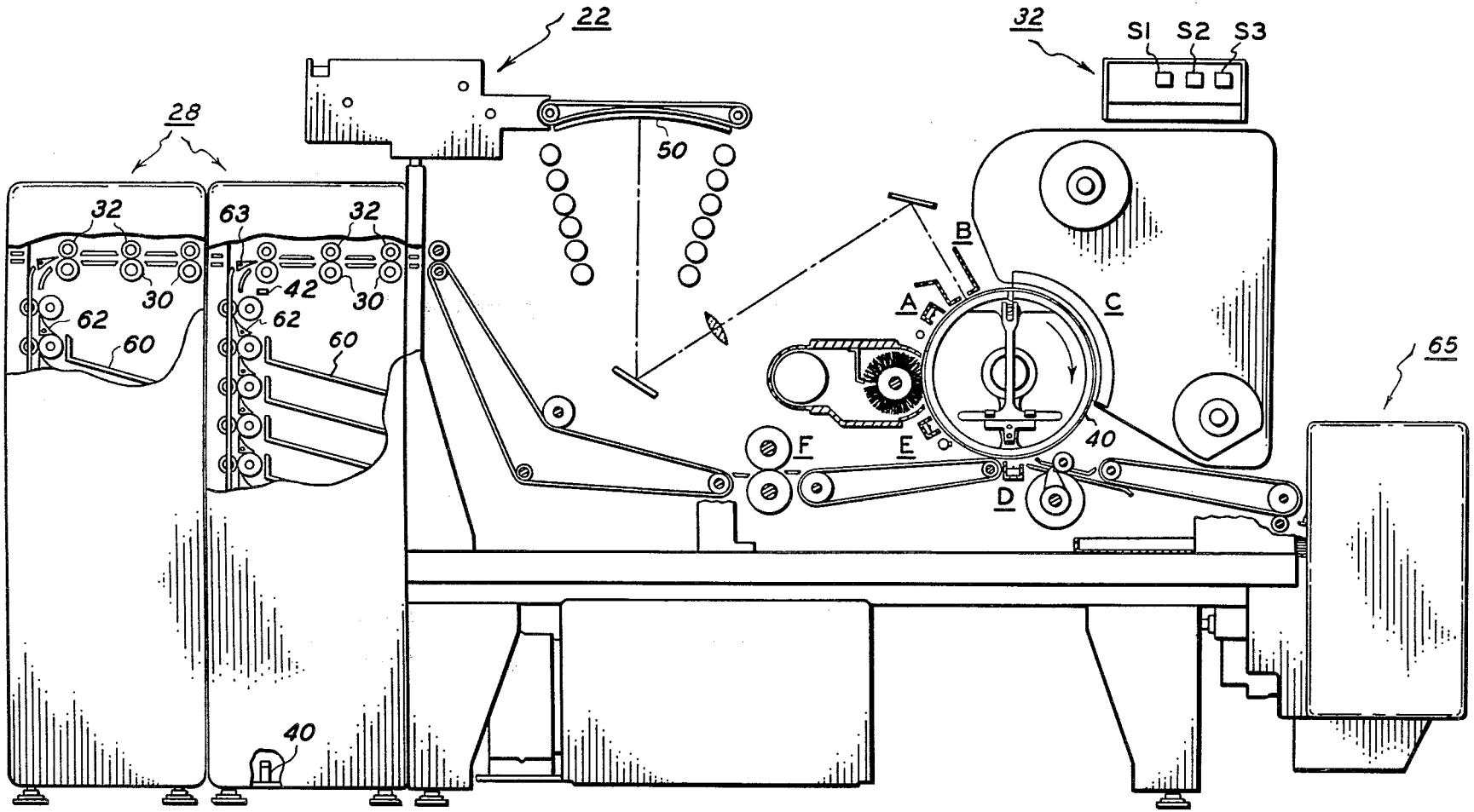
FIG. 1 illustrates schematically in an electrostatographic reproducing machine including a document feeder and a plurality of modular sorter assemblies operated and controlled in accordance with the instant invention.

In FIG. 1 is shown an electrostatographic reproducing machine which comprises a document feeding apparatus 22 positioned on a xerographic processor 25 which transports copy sheets to a plurality of modular sorting assemblies 28. A control panel 32 includes the usual counters and buttoms including a switch S1 for start print, a switch S2 for sorting on and a switch S3 for document feeder on. The processor includes a drum shaped member 40 including a photoconductive layer or light receiving surface on a conductive backing. The drum member is mounted on a shaft journaled in a frame to rotate in the direction of the arrow to cause the drum surface to pass sequentially a plurality of xerographic processing stations.

For the purpose of the present disclosure the processing stations in the path of movement of the drum surface may be described functionally as follows:

A charging station A at which a uniform electrostatic charge is deposited on the photoconductive layer of the drum;

An exposure station B at which a light or radiation pattern is projected onto the drum surface to thereby dissipate the drum charge in the exposed areas thereby forming a latent electrostatic image of the copy to be reproduced;

A developing station C at which a xerographic developing material including toner particles having an electrostatic charge opposite to that of the electrostatic latent image are cascaded over the drum surface whereby the toner particles adhere to the latent electrostatic image to produce a xerographic powder image in a configuration of the copy being reproduced;

A transfer station D at which the powder image is electrostatically transferred from the drum surface to copy sheet made of paper material;

A drum cleaning and discharge station E at which the drum surface is cleaned to remove residual toner particles thereon after image transfer and at which the drum surface is exposed so a relatively bright light source to effect substantially complete discharge of any residual electrostatic charge remaining thereon; and A fusing station at which the powder image is permanently affixed to the copy sheet which is paper and which is transported to a plurality of modular sorter assemblies 28 for producing collated sets of the document information.

For a more detailed description of the processor reference is made to U.S. Pat. No. 3,301,126 to Osborne et al which is commonly assigned herewith.

It should be understood that the copier/duplicator machine can utilize a document feeding apparatus 22 as described in the above mentioned patent which feeds documents onto the platen 50 of the processor, or, alternatively, the documents may be handled manually by a machine operator. Copy sheets produced by the processor are distributed to the modular sorter assemblies 28 by drive rolls 30 with cooperating idler rolls 32 to move the sheets past the inlets of bins 60. A light source 40 and a photodetector 42 are located in each of the sorting assemblies to detect the presence of copy sheets entering the bins. The sheets are diverted into the apporpriate bin in sequence beginning with the top bin and proceding towards the bottom bin by gate members 62. Subsequently, sheets are directed towards the next modular sorter assembly by a set of gate members 63. The structure of the drive rolls and gate members in their operation is described more fully in the above U.S. Pat. No. 3,467,371 issued Sept. 16, 1969 and commonly assigned with the instant application.

In accordance with the present invention both the lead edge and a trail edge of the copy sheets serve to advance the index mechanism for actuating the gate members in each of the modular sorter assemblies 28. In the prior art devices, only the trail edge was used to advance the indexing mechanism which operated the gate members in their sequence. This type of operation required that the logic store the arrival of the lead edge of the copy sheet in order that it would recognize the trail edge when it appeared. The disadvantage of the prior art devices is that it required a more complex circuitry which was less reliable than that of the instant invention. Another disadvantage of the prior art system is that it required complete entry of the copy sheet into a tray before the next action could be initiated in the control logic. As a result, the copy sheets had to be separated by a minimum distance equal to that at least between the uppermost and lowermost bin which delayed the sorting operating unnecessarily or otherwise required unduly high transport speeds.

Referring now to FIGS. 2 – 5, the gate members 62 for each of the bins are moved to an open position by a cam follower 65 which is actuated by a cam 67 rotated by a shaft member 69. Shaft member 69 is rotated by motor 71. The angular rotation of shaft member 69 is dependent on a cam switch which is actuated by cam 75 fixed to the shaft member as will be described more fully hereinafter. It will be noted that there is one set of gate members for each bin and also an additional set of gate members 63 located at the top of each modular sorter assembly which is used to direct the copy sheet to the next modular sorting assembly as described above. It will be further appreciated that the lower most set of gate members 62 is fixed in the open position and therefore does not have to be actuated.

In accordance with the invention a cam member 100 is fixed to shaft member 69 for rotation therewith. Cam member 100 includes a plurality of cam indents for each of the gates which are actuated. Each of the indents has a position A for one state and a position B for a second state as will be explained more fully hereinafter. The cam member 100 operates a swithc 102 which has two states. The two states A and B act in conjunction with the two states of a relay (not shown) having relay contacts 105 and 107 (FIG. 5) which complete the circuit to a power supply 108 for energizing motor 71. It will be appreciated that in lieu of a relay and switch that a photodetector with solid state logic and driver can be used.

In operation, for the first or topmost bin the switch 102 actuator as determined by cam 100 is in position A representing a state A and the light path of light source 40 is clear. The relay is also in position A and the circuit to the motor 71 is open. As a copy sheet starts to enter the first bin the light beam is interrupted. As a result the relay changes to a state B closing the circuit to the motor. The motor turns the cam 100 a small angle to position B where the switch changes to state B. At this time the circuit is open and the motor stops. External linkages are such that the small angle of movement does not change the state of the gate members or any other related operation. As the copy sheet clears the light beam the relay changes back to state A and the circuit to the motor is completed through the switch 102 which is in state B. The motor then advances until switch 102 is returned to state A in the next cam indentation. The external linkages are such that first or uppermost set of gate members close and the next set of gate members open. This operation continues for each of the set of gate members until all of the gate members to each of the associated bins have been opened in sequence. The eleventh set of gate members 63 are opened last which directs the copy sheets into the next modular sorting assembly. Since the lowermost set of gate members in the modular sorting assembly are fixed open, it is not necessary to change its state. The switch cam dwell at the tenth set of gate members is extended so that the position B is not encountered until the motor has advanced far enough to operate the topmost set of gate members 63. In this manner the leading edge of the tenth sheet causes the gate members to be prepared for the eleventh sheet. This reduces the minimum distance between the trailing edge of the tenth sheet and leading edge of the eleventh sheet.

Figure 6:
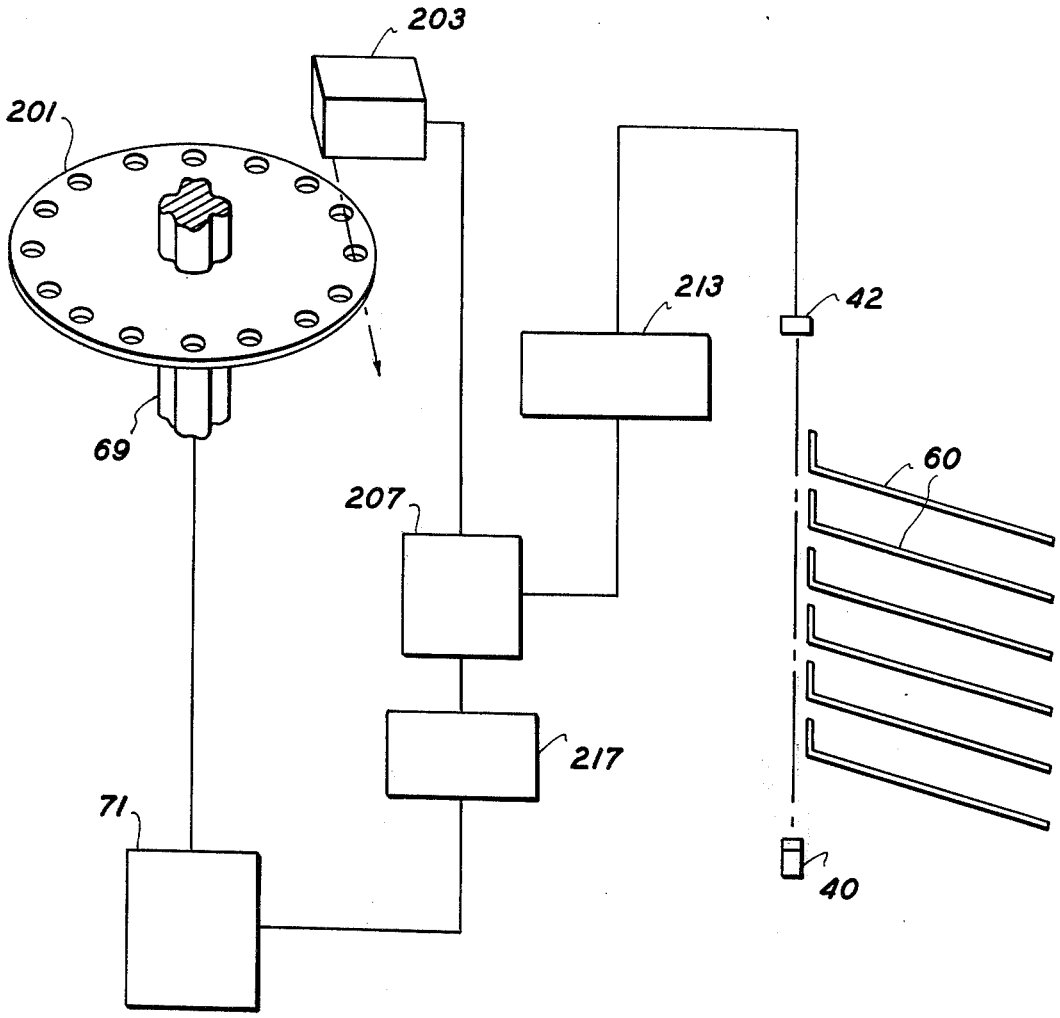
FIG. 6 is a schematic of an alternative embodiment of the present invention.

In lieu of the relay and cam operation an alternative solid state program can be used as shown in FIG. 6. A coded disc member 201 is substituted for cam 100 and combined lamp and photodetector device 203 replaces the switch 102. Light is detected by photodetector device 203 and signals are supplied to AND gate 207. Signals from detector 42 are supplied to AND gate 207 via inverter 213. The output of gate 207 is supplied to a driver 217 which drives motor 71.

For condition A the disc member 201 is in such a position that the photodetector device 203 reads a HIGH condition. The photodetector 42 is clear which also indicates a HIGH condition. These conditions are compared at AND gate 207 which is not satisfied and there is no further output. As a sheet enters a bin photodetector 42 is blocked and goes to a LOW condition. At this time the signal inverted by inverter 213 and the signal from photodetector device 203 are both HIGH and motor 71 is energized. The motor remains energized until the disc member 201 rotates to a dark position. External linkages are such that the small angle of movement does not change the state of the gate members or any other related operation. The operation continues as described above until all the gate members are opened and closed in proper sequence.

Above is described control system for modular sorter assemblies in which the indexing mechanism for controlling gates for admitting copy sheets into sorting bins is improved by increased speed in sheet handling while improving reliablity.

While this invention has been described with reference to the structure disclosed, it is not confined to the details set forth, but is intended to cover such modifications or changes as may come within the scope of the following claims.

What is claimed is:

1. An improved control system for modular sorter assemblies which distribute copy sheets into bins in collated sets from document information reproduced by a copier/duplicator machine comprising:

a plurality of modular sorter assemblies operative to receive copy sheets sequentially, an array of sorting bins in each assembly to receive copy sheets in collated sets, gate members associated with each of the bins to deflect copy sheets thereinto from a sheet path, gating means operative to control the distribution of copy sheets into the next modular sorter assembly after sorting is completed in the bins in a particular assembly, a cam member associated with each assembly, said cam member having a plurality of cam indents with each indent corresponding to an associated gate member or gating means and arranged for controlling the opening and closing of said gate members and gating means in a predetermined sequence, drive means for rotating said cam member and actuating said gate members and gating means, and circuit means including a photodetector means operating two contacts which are opened and closed as sheet presence and absence is detected at the bins entrance and switching means associated with said contacts and activated by said cam member for energizing said drive means to actuate said gate members and said gating means in proper sequence in response to the presence and absence of copy sheets at the entrance of the bins, wherein said switching means includes a single pole double throw switch which changes state from a first condition when said cam member rotates to position a predetermined detent at said switch to a second condtion when said cam member further rotates to move said predetermined detent away from said switch, wherein the movement of the cam member occurs for both the presence and absence of sheets at the bin's entrances.

* * * * *